US005576747A

United States Patent [19]

Sohn

[11] Patent Number: 5,576,747

[45] Date of Patent: Nov. 19, 1996

[54] ELECTROSTATIC HYDRODYNAMIC JET WRITING METHOD USING ELECTRO-RHEOLOGICAL FLUID AND APPARATUS THEREOF

[75] Inventor: Sang-suk Sohn, Suwon, Rep. of Korea

[73] Assignee: Samsung Electronics Co., Ltd., Kyungki-do, Rep. of Korea

[21] Appl. No.: 309,471

[22] Filed: Sep. 22, 1994

Related U.S. Application Data

[63] Continuation of Ser. No. 999,117, Dec. 31, 1992, abandoned.

[30] Foreign Application Priority Data

Jun. 30, 1992 [KR] Rep. of Korea ..... 92-11633

[51] Int. Cl.[6] ..... B41J 2/06

[52] U.S. Cl. ..... 347/48; 347/55

[58] Field of Search ..... 347/48, 55, 100, 347/15

[56] References Cited

U.S. PATENT DOCUMENTS 3,480,962 11/1969 Weigl ..... 347/51
3,790,703 2/1974 Carley ..... 347/48 X
4,014,693 3/1977 Clark ..... 347/54 X
4,314,263 2/1982 Carley ..... 347/48
4,710,780 12/1987 Saito ..... 347/48 X

FOREIGN PATENT DOCUMENTS 2-178054 7/1990 Japan ..... B41J 2/06

*Primary Examiner*—Joseph W. Hartary
*Attorney, Agent, or Firm*—Rothwell, Figg, Ernst & Kurz

[57] ABSTRACT

An electrostatic hydrodynamic jet writing method for writing a desired imaged using an electro-rheological fluid is disclosed wherein a writing potential for forming an electric field is applied to a nozzle of an injection head according to a writing signal to vary the viscosity of the ink flowing through the nozzle and to control the flow of the ink. Simultaneously, an accelerating potential is applied between the nozzle and an accelerating electrode on which paper is guided so as to transfer ink of lowered viscosity from the nozzle to the accelerating electrode to perform writing.

10 Claims, 3 Drawing Sheets

ELECTROSTATIC HYDRODYNAMIC JET WRITING METHOD USING ELECTRO-RHEOLOGICAL FLUID AND APPARATUS THEREOF

This is a continuation of application Ser. No. 07/999,117, filed Dec. 31, 1992 now abandoned.

BACKGROUND OF THE INVENTION

1. Field of the Invention

The present invention relates an apparatus for writing images by injecting ink and, particularly, to an electrostatic hydrodynamic jet writing method using electro-rheological fluid and apparatus therefor which uses electro-rheological fluid and controls the ejection of the fluid by using one electrical potential for varying the viscosity of the fluid and another electrical potential for electrostatic induction of the fluid.

2. Description of Prior Art

Electro-rheological fluid is well-known for its electro-field responsiveness. The electro-rheological fluid was first disclosed in U.S. Pat. No. 2,417,850 by Winslow in 1943, and has thereafter been proposed in various forms as disclosed in U.S. Pat. No. 3,047,507 by Winslow, USSR patent 1391951 by Lysenkov and U.S. Pat. No. 4,812,251 by Stangroom.

The electro-rheological fluids proposed by the aforementioned publications are basically made of electric-viscosity liquid containing a powdery additive of a minute particle diameter. Thus, if an electric field is applied to the fluid, the viscosity thereof varies. The viscosity of these electro-rheological fluids has been known to vary in proportion to the strength of the applied electric field. This is referred to as electric viscosity effect. The electric viscosity effect is a phenomenon whereby the viscosity of a fluid is varied depending on the strength of an applied electric field, and varies almost concurrently with the electric field application. Among the above-described electro-rheological fluids, there is one whose viscosity varies from a liquid state to a nearly solid state by application of an electric field even below 10 KV/mm.

Using electro-rheological ink having such an electric viscosity effect and an appropriate controller, an intended image can be written. An apparatus for writing images using such electro-rheological ink is disclosed in Japanese laid-open patent publication Sho 55-117663.

FIG. 1 illustrates a conventional head for injecting such electro-rheological ink comprising a nozzle sheet 1 and a pair of support sheets 2 and 3 stacked about nozzle sheet 1. Nozzle sheet 1 has an ink reservoir la for receiving ink in a certain quantity and a nozzle 1*b* for ejecting ink therefrom. Upper support sheet 2 has an ink supplying aperture 2*a* and an electrode plate 4. Lower support sheet 3 has another electrode plate 4'. In this configuration, a predetermined pressure is kept with respect to the inside and outside of nozzle 1*b*. The viscosity of the ink inside the nozzle is varied by a writing potential 5 applied to the pair of electrode plates 4 and 4'. When the ink has a low viscosity, i.e. liquid, the ink is ejected due to the pressure difference between the inside and outside of the nozzle. That is, the viscosity of the ink inside the nozzle is varied by the strength of the electric field formed by the two electrodes. Thus, the ink is not ejected when it has a high viscosity, i.e. nearly solid, and is ejected when it has a low viscosity. Such an apparatus for ejecting electro-rheological ink, according to the writing potential, requires an additional means for creating the pressure difference inside and outside the nozzle and holding the pressure difference. This causes the apparatus to be more complicated and expensive while impeding its miniaturization.

An electrostatic hydrodynamic jet method has been proposed and disclosed in U.S. Pat. No. 3,060,429 to solve the aforementioned disadvantage in apparatuses using the electro-rheological fluid. FIG. 2 illustrates such an electrostatic hydrodynamic apparatus which utilizes an accelerating potential 9 applied, according to a writing signal, between a nozzle 6a at the end of an ink reservoir 6 and a platen 8 onto which paper 7 is guided. In this device, the ink is ejected from the nozzle onto the paper due to the static electricity induced into the ink by the accelerating potential difference (the potential difference between the nozzle and the platen). This apparatus is simplified, in comparison with the above-described electro-rheological fluid writing apparatus, because it does not produce pressure and, in turn, the pressure does not need to be controlled. However, even though continued research has greatly reduced the necessary writing potential, it is still almost the same as the accelerating potential. Consequently, a high voltage must still be controlled, which is difficult, resulting in a more complicated and undesirable method and apparatus for high-resolution writing.

SUMMARY OF THE INVENTION

Therefore, it is an object of the present invention to provide an electrostatic hydrodynamic jet writing method using an electro-rheological fluid which uses electro-rheological ink and applies a potential for varying the viscosity of the ink and a potential for the electrostatic induction of the ink, so as to facilitate the control of the ink.

It is another object of the present invention to provide an electrostatic hydrodynamic jet writing apparatus using an electro-rheological fluid accomplishing the above writing method which is simplified and is favorable to a high-resolution writing.

To accomplish the first object, there is provided an electrostatic hydrodynamic jet writing method using an electro-rheological fluid wherein, in writing a desired image by ejecting ink, a writing potential for forming an electric field is applied to a nozzle of an ejection head for storing electro-rheological ink according to a writing signal to vary the viscosity of the ink flowing through the nozzle. The writing potential also controls the flow of the ink. Simultaneously, an accelerating potential is applied between the nozzle and an accelerating electrode on which paper is guided so as to transfer ink having lower viscosity from the nozzle to the accelerating electrode to perform writing.

To accomplish the second object, there is provided an electrostatic hydrodynamic jet writing apparatus using an electro-rheological fluid for creating a desired image comprising an ejection head for storing electro-rheological ink and having a nozzle for ejecting the ink. The ejection head further comprises a valve means for controlling the ink flow by applying a writing potential for forming an electric field which varies the viscosity of the ink to the passage inside the nozzle. An accelerating means is also provided for applying an accelerating potential to the nozzle and an accelerating electrode so as to transfer the ink of lowered viscosity from the nozzle onto paper due to the electrostatic hydrodynamic force induced between the nozzle and accelerating electrode, whereby the flow of the ink is controlled by the writing potential and the ejection of the ink is controlled by the accelerating potential.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

Figure 3:
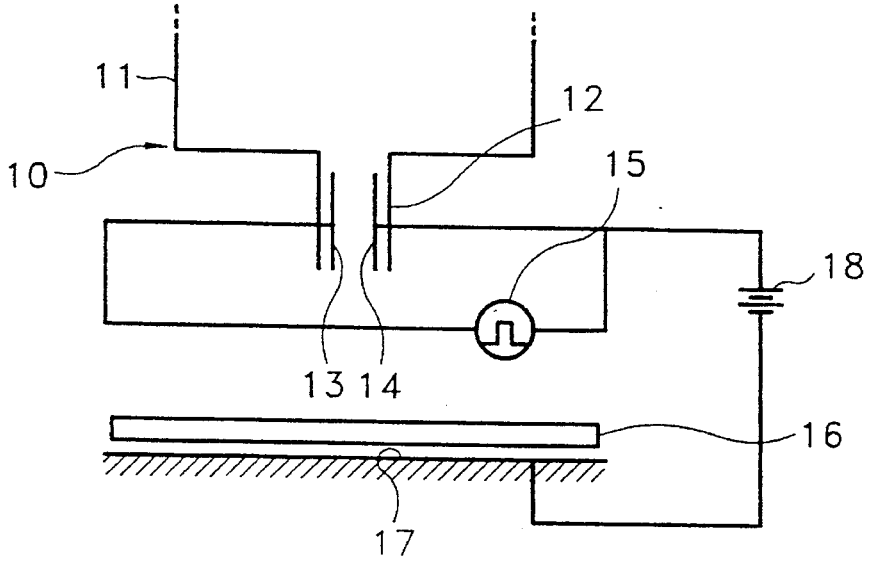
FIG. 3 is a schematic view of an electrostatic hydrodynamic jet apparatus using an electro-rheological fluid in accordance with one embodiment of the present invention.

FIG. 3 illustrates an electrostatic hydrodynamic jet apparatus using an electro-rheological fluid in accordance with the present invention comprising an ejection head 10 having an ink reservoir 11 for storing a certain amount of ink and a nozzle 12 for ejecting ink from ink reservoir 11. Ink reservoir 11 is filled with ink by an ink supply means (not shown), such as a suitable ink jet printer head. The ink stored in ink reservoir 11 has an electric viscosity which varies in relation to an electric field, and is obtained by suspending a fine ink powder into electro-rheological fluid. So that it functions as a writing ink, the electro-rheological fluid is mixed with color, dyes, a coagulant and an anticorrosive or a diffusing agent. Also, to keep the fluid properly mixed, an ink powder is chosen which has a density similar to the density of the electro-rheological fluid so as not to be precipitated. A mixer may also be adapted to prevent deposition or floating of the additive created due to a density difference.

The ink produced according to the above method is continuously supplied to nozzle 12 connected to ink reservoir 11 by way of capillary action so that the ink is injected through the nozzle.

For high resolution, high speed and various colors, nozzle 12 of ejecting head 10 may be arranged in groups or in the mesh type such as an ink jet printer head or thermal head.

Figure 1:
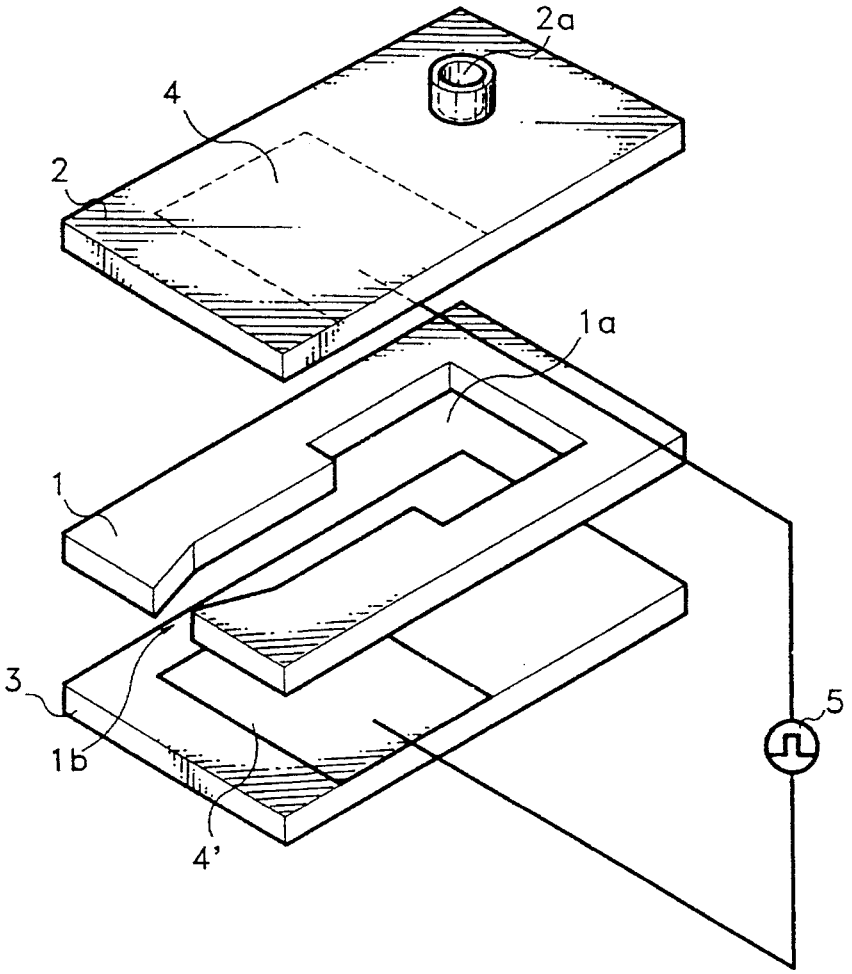
FIG. 1 (PRIOR ART)
FIG. 1 illustrates a head for ejecting electro-rheological fluid in accordance with conventional writing technology using the fluid.
Figure 2:
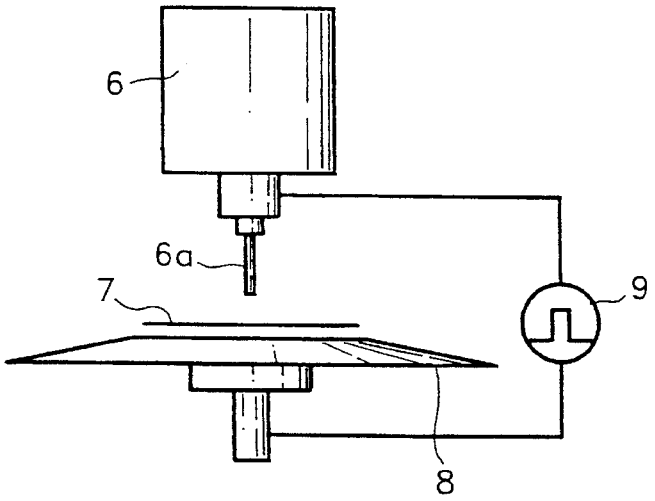
FIG. 2 (PRIOR ART)
FIG. 2 is a cross-sectional view of an ejecting head and a platen illustrating conventional electrostatic hydrodynamic writing technology.

The electrostatic hydrodynamic jet of the present invention also comprises a valve means for varying the viscosity of the ink filling nozzle 12 and to control the flow of the ink inside the nozzle. In one embodiment, the valve means comprises two electrodes 13 and 14 which are installed inside nozzle 12 in opposing relation to each other and at a predetermined distance. The valve means also comprises a writing potential means for creating an electrical potential applied to electrodes 13 and 14, indicated generally by element 15. This writing potential means produces a predetermined writing potential for producing an electric field which varies the viscosity of ink is applied to two electrodes 13 and 14. The writing potential is intermittently applied according to a writing signal modulated to create a desired image. Here, since the electric field of the present invention needs only to admit or interrupt the flow of ink via nozzle 12, the applied writing potential applied by writing potential means 15 can be lower than the writing potential in the conventional writing technology, as illustrated in FIG. 1, using the electro-rheological fluid.

The electrostatic hydrodynamic jet utilizes an accelerating means for transferring the ink, whose viscosity is varied under control of the valve means, from the nozzle 12 and onto paper 16. The accelerating means comprises means 18 for applying a predetermined accelerating potential to nozzle 12 and a platen 17 on which paper 16 is guided, so as to form an electrostatic potential for accelerating the movement of the ink having lowered viscosity. Then, without the difference of the pressure applied inside and outside the nozzle as in the conventional method, the ink having the low viscosity, i.e. in a liquid state, varied by the valve means is ejected onto paper 16 by the accelerating force created due to the static electricity. It is sufficient to maintain the accelerating means 18 to a predetermined potential which accelerates the ink only when the writing signal is present.

In accordance with one embodiment, the valve means and the accelerating means have a simplified structure in that one of two electrodes 13 and 14 of nozzle 12 is taken as a common electrode, and the writing potential means 15 and accelerating potential means 18 are commonly connected thereto.

The image writing operation of the present invention will be described below.

The ink filling ink reservoir 11 of an injecting head 10 is supplied to the nozzle via capillary action. The ink is kept in a state of equilibrium by the capillary action, surface tension and gravity, and thus forms a meniscus at the end of nozzle 12.

In this state, when a writing potential is applied, the ink inside nozzle 12 has a shearing yield stress so as not to flow, since the ink has a high viscosity, i.e. a gel state. When a writing potential is not applied, the ink takes on a lower viscosity to become molten. However, the liquidity of the ink is not enough to permit the ink to flow through nozzle 12 and be discharged.

When the accelerating potential is applied, the ink inside nozzle 12 is electrostatically induced due to the accelerating potential to move toward platen 17 which is the accelerating electrode. Then, if the ink viscosity inside nozzle 12 is lowered to be in a more liquid state, the ink is ejected. If the ink is in a gel state, even the accelerating force does not result in the ejection of the ink. In other words, the ink inside nozzle 12 receives multilevel forces from the writing potential and accelerating potential, and desired images can be written only by appropriately selecting the time and condition of the forces.

The relationship of forces acting stepwise so as to permit creation of desired written images is described by the following:

$$f(k_1, Er/L) > f(\xi e, Ea^2) > R$$

where, $k_1$ is a specific constant of electro-rheological ink;

Er is a writing potential difference;

L is the distance between electrodes 13 and 14;

$f(k_1, Er/L)$ is the shearing yield value due to the writing potential difference;

$\xi e$ is the corresponding dielectric constant;

Ea is the accelerating potential difference;

$f(\xi e, Ea^2)$ is the electrostatic hydrodynamic force of ink due to the accelerating potential difference; and R is the summed total force of fluid friction, surface tension and gravity inside the nozzle.

Here, if electrode 14 between electrodes 13 and 14 of nozzle 12 is taken as a common electrode and writing potential means 15 and accelerating potential means 18 produce the same potential at the common electrode, since the ink inside nozzle 12 has a low viscosity, i.e. liquidity, shearing yield value $f(k_1, Er/L)$ of the ink according to the writing potential approximates zero. And, according to $f(\xi e, Ea^2)>R$, the electrostatic hydrodynamic force of the ink due to the accelerating potential is greater than R, the ink is ejected to paper 16. Here, the ejected ink is proportionally accelerated as it approaches platen 17 which is the accelerating electrode. This is because the accelerating potential difference is inversely proportional to the square of the distance from platen 17.

When the expression $f(\xi e, Ea^2)>R$ is true, as when writing potential is applied, the shearing yield value of the ink inside nozzle 12 is raised due to the properties of the Bingham model and the viscosity of the ink is raised from liquidity to a gel state. Here, since the shearing yield value due to writing potential is greater than the electrostatic hydrodynamic force of the ink due to accelerating potential, the electro-rheological ink is not ejected.

The action is repeated according to the writing signal modulated by desired images. Thus, the desired images are written as the ink is ejected onto paper 16 according to the writing signal. Here, paper 16 (either ordinary paper or film) should be conveyed synchronous with the writing signal. The image writing can be also carried out onto a transferring drum as well as paper 16.

Figure 4:
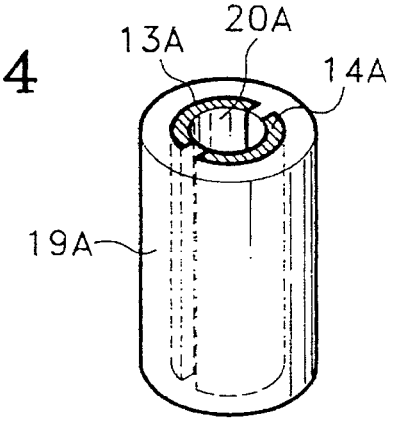
FIGS. 4 to 6 illustrate examples of a nozzle for ejecting the electro-rheological fluid in accordance with further embodiments of present invention.

FIG. 4 illustrates an example of nozzle 12 of injecting head 10 according to the present invention. The nozzle has a cylindrical nozzle body 19A on the inner surface of which two electrodes 13A and 14A are installed, which can be easily manufactured. Nozzle body 19A also includes a passage 20A and, because of its non-uniform electric field, effective valving action of the electro-rheological ink is not expected.

Figure 5:
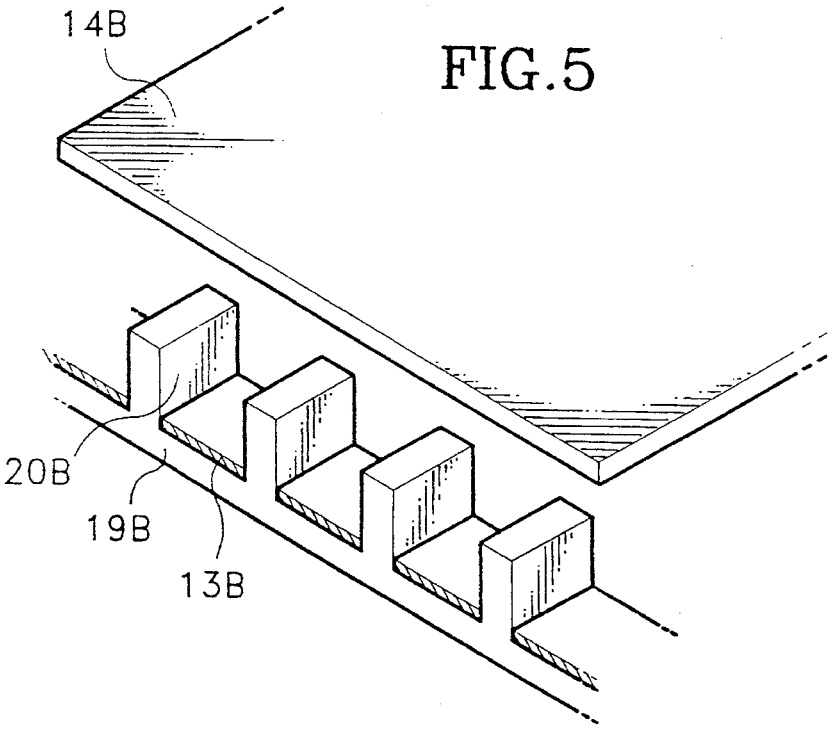

FIG. 5 illustrates a multiple nozzle structure in accordance with another embodiment of the present invention comprising a plurality of passages 20B which are partitioned in equal intervals in nozzle body 19B. Writing electrode 13B, connected to writing potential means 15, is provided on the inner surface of passages 20B, respectively. A common electrode 14B of a metal film is coated on them. This nozzle structure is advantageous to high integration. Here, since the viscosity of the ink flowing through passages 20B is varied inversely proportional to the distance between writing electrode 13B and common electrode 14B, in order to obtain a desired variation characteristic of the electric viscosity and simultaneously reduce writing potential 15, the distance between the two electrodes should be as narrow as possible. At the same time, it should be considered that the ink ejected through passages 20B be secured as an amount sufficient for writing.

Figure 6:
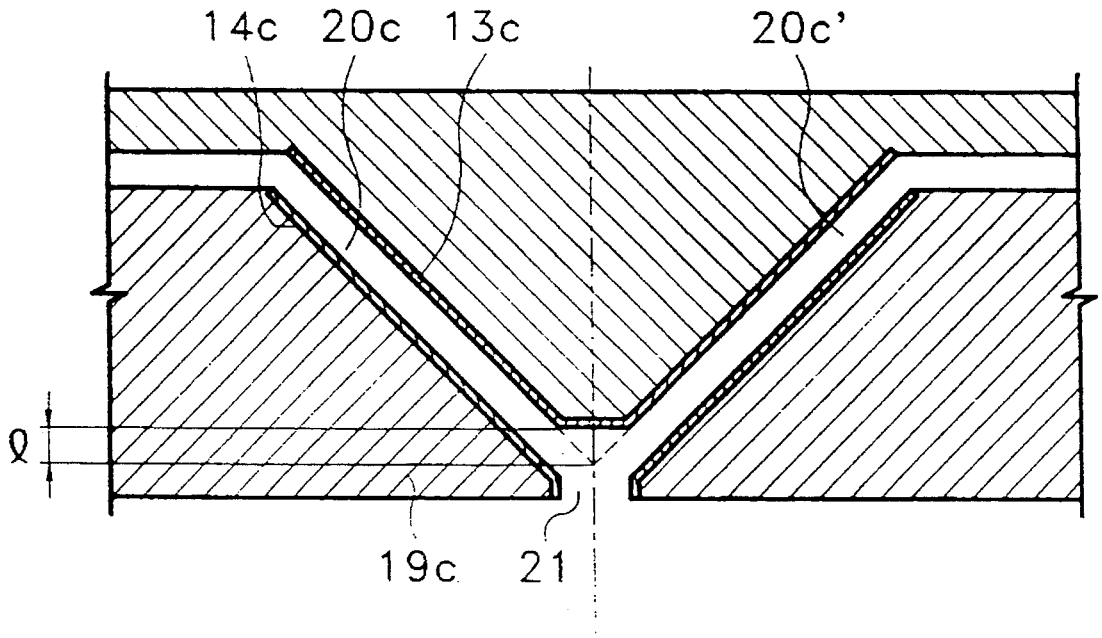

FIG. 6 illustrates a most preferred embodiment of nozzle 12 which comprises an injecting head 10, a pair of passages 20C and 20C' formed at equal angle in nozzle body 19C and converge on a nozzle aperture 21 in the front of the nozzle body. Two electrodes 13C and 14C are installed along passages 20C and 20C', respectively. In this structure, the gap between two electrodes 13C and 14C is very small, so as to greatly reduce the applied writing potential, and at the same time, permitting sufficient quantities of ink to be ejected to nozzle aperture 21. Further, since, depending upon the angle of passages 20C and 20C', dimension l is appropriately set to secure more ink than amount injected through nozzle aperture 21, the embodiment is advantageous in its design and manufacture. High integration can also be accomplished by arranging such a nozzle structure as a plurality of lines on a plate.

As described above, the present invention uses an accelerating potential lower than that of the conventional electrostatic hydrodynamic jet writing method and does not need to apply pressure for outletting ink from the nozzle contrary to the conventional electro-rheological fluid. Thus, the present invention facilitates greater control and miniaturization of the apparatus. Further, in the present invention, a low shearing permission stress of the ink (due to the electro-rheological effects of the nozzle) is afforded by the injection characteristics. Especially, different from a conventional bubble-type ink jet head or an ink jet head using a piezoelectric element, the present invention has a simplified head and is not deformed by high temperature nor high pressure, thereby lengthening its life. Furthermore, through the smooth control of a low voltage and a miniaturized apparatus, the present invention realizes high speed and high resolution writing.

What is claimed is:

1. An electrostatic hydrodynamic jet writing method for writing a desired image using an electro-rheological fluid, said method comprising the steps of:

(a) storing an ejection head having a nozzle with an electro-rheological ink of lowered viscosity;

(b) applying a writing potential to said nozzle for forming an electric field according to a writing signal to vary said electro-rheological ink into a high viscosity fluid thereby controlling the unwanted flow of said electro-rheological ink in the passage inside said nozzle; and (c) cutting off said writing potential and simultaneously applying an accelerating potential between said nozzle and an accelerating electrode on which paper is guided so as to transfer said electro-rheological ink of lowered viscosity from said accelerating electrode to perform writing, wherein said nozzle of said ejecting head comprises a nozzle body and a pair of passages formed at an equal angle in said nozzle body and which converge on an opening of an aperture in said nozzle body.

2. An electrostatic hydrodynamic jet writing apparatus for writing a desired image using an electro-rheological fluid, said apparatus comprising:

(a) an ejection head storing electro-rheological ink of lowered viscosity, having a nozzle for ejecting said electro-rheological ink, and first and second electrodes oppositely provided within passages inside said nozzle;

(b) an accelerating electrode on which paper is guided;

(c) a writing potential being applied between said first and second electrodes for varying said electro-rheological ink into a high viscosity to control the unwanted flow said electro-rheological ink from said nozzle; and (d) an accelerating potential being applied between said first electrode and said accelerating electrode for transferring said electro-rheological ink toward said accelerating electrode, wherein said nozzle of said ejecting head comprises a nozzle body and a pair of passages formed at an equal angle in said nozzle body and which converge on an opening of an aperture of said nozzle body.

3. An electrostatic hydrodynamic jet writing apparatus for writing a desired image using an electro-rheological fluid as claimed in claim 2, wherein said writing potential is modulated in accordance with a writing signal.

4. An electrostatic hydrodynamic jet writing apparatus for writing a desired image using an electro-rheological fluid, said apparatus comprising:

(a) an ejection head storing electro-rheological ink of lowered viscosity, having a nozzle for ejecting said electro-rheological ink;

(b) valve means for controlling the unwanted flow of said electro-rheological ink in the passage inside said nozzle by applying a writing potential for forming an electric field to said nozzle in accordance with a writing signal so that said electro-rheological ink has a high viscosity;

(c) accelerating means for transferring said electro-rheological ink of lowered viscosity from said nozzle onto an accelerating electrode on which paper is guided by cutting off said writing potential and simultaneously applying an accelerating potential between said nozzle and said accelerating electrode; and wherein said nozzle of said ejecting head comprises a nozzle body, at least one nozzle aperture in the front of said nozzle body and a pair of passages formed at an equal angle in said nozzle body and which converge on said nozzle aperture.

5. An electrostatic hydrodynamic jet writing apparatus for writing a desired image using an electro-theological fluid, said apparatus comprising:

(a) an ejection head storing electro-rheological ink of lowered viscosity, having a nozzle for ejecting said electro-rheological ink, and first and second electrodes oppositely provided within passages inside said nozzle;

(b) an accelerating electrode on which paper is guided;

(c) a writing potential being applied between said first and second electrodes for varying said electro-rheological ink into a high viscosity to control the unwanted flow of said electro-rheological ink from said nozzle, said nozzle of said ejecting head comprising a nozzle body, at least one nozzle aperture in the front of said nozzle body and a pair of passages formed at an equal angle in said nozzle body and which converge on said nozzle aperture; and (d) an accelerating potential being applied between said first electrode and said accelerating electrode for transferring onto said accelerating electrode, wherein said electro-rheological ink of lowered viscosity is ejected by cutting off said writing potential and simultaneously applying said accelerating potential to perform writing.

6. An electrostatic hydrodynamic jet writing apparatus for writing a desired image using an electro-rheological fluid, said apparatus comprising:

(a) an ejection head storing electro-rheological ink of lowered viscosity, having a nozzle for ejecting said electro-rheological ink;

(b) valve means for controlling the unwanted flow of said electro-rheological ink in the passage inside said nozzle by applying a writing potential for forming an electric field to said nozzle in accordance with a writing signal so that said electro-rheological ink has a high viscosity;

(c) accelerating means for transferring said electro-rheological ink of lowered viscosity from said nozzle onto an accelerating electrode on which paper is guided by cutting off said writing potential and simultaneously applying an accelerating potential between said nozzle and said accelerating electrode; and wherein terminals of both said writing potential and said accelerating potential are commonly connected to each other so as to be equipotential.

7. An electrostatic hydrodynamic jet writing apparatus using an electro-rheological fluid as claimed in claim 6, wherein said valve means comprises two opposing electrodes positioned on said passages of said nozzle.

8. An electrostatic hydrodynamic jet writing apparatus using an electro-rheological fluid as claimed in claim 6, wherein said accelerating electrode is a platen for guiding paper.

9. An electrostatic hydrodynamic jet writing method for writing a desired image using an electro-rheological fluid, said method comprising the steps of:

(a) storing an ejection head having a nozzle with an electro-rheological ink of lowered viscosity;

(b) applying a writing potential to said nozzle for forming an electric field according to a writing signal to vary said electro-rheological ink into a high viscosity fluid thereby controlling the unwanted flow of said electro-rheological ink in the passage inside said nozzle; and (c) cutting off said writing potential and simultaneously applying an accelerating potential between said nozzle and an accelerating electrode on which paper is guided so as to transfer said electro-rheological ink of lowered viscosity to said accelerating electrode to perform writing, wherein said writing potential and accelerating potential form a common electrode so as to be equipotential.

10. An electrostatic hydrodynamic jet writing apparatus for writing a desired image using an electro-rheological fluid, said apparatus comprising:

(a) an ejection head storing electro-rheological ink of lowered viscosity, having a nozzle for ejecting said electro-rheological ink, and first and second electrodes oppositely provided within a passage inside said nozzle;

(b) an accelerating electrode on which paper is guided;

(c) a writing potential being applied between said first and second electrodes for varying said electro-rheological ink into a high viscosity to control the unwanted flow of said electro-rheological ink from said nozzle; and (d) an accelerating potential being applied between said first electrode and said accelerating electrode for transferring said electro-rheological ink toward said accelerating electrode, wherein said writing potential and said accelerating potential form a common electrode so as to be equipotential.

* * * * *